United States Patent [19]

Stoltman et al.

[11] Patent Number: 4,499,879

[45] Date of Patent: Feb. 19, 1985

[54] FUEL SUPPLY SYSTEM FOR AN INTERNAL COMBUSTION ENGINE

[75] Inventors: Donald D. Stoltman, Henrietta; Gary A. Nichols, Rochester, both of N.Y.

[73] Assignee: General Motors Corporation, Detroit, Mich.

[21] Appl. No.: 489,696

[22] Filed: Apr. 28, 1983

[51] Int. Cl.[3] ..... F02B 3/00

[52] U.S. Cl. ..... 123/480; 123/478

[58] Field of Search ..... 123/480, 478, 472, 179 G, 123/486; 364/431.05; 73/119 A

[56] References Cited

U.S. PATENT DOCUMENTS

| | | | |
|---|---|---|---|
| 4,205,604 | 1/1981 | Labiff | 123/480 |
| 4,245,605 | 6/1981 | Rice et al. | 123/480 |
| 4,309,759 | 6/1982 | Iokuda et al. | 123/480 |
| 4,389,994 | 6/1983 | Denz et al. | 123/480 |
| 4,398,520 | 8/1983 | Schulz et al. | 123/481 |
| 4,402,294 | 9/1983 | McHugh et al. | 123/480 |
| 4,416,240 | 11/1983 | Matsuoka | 123/480 |
| 4,454,852 | 6/1984 | Hasegawa | 123/480 |
| 4,454,853 | 6/1984 | Hasegawa | 123/480 |

*Primary Examiner*—Raymond A. Nelli

*Attorney, Agent, or Firm*—Howard N. Conkey

[57] ABSTRACT

A system for providing the fuel requirements of an engine based on an estimated value of the temperature of the intake region of the engine.

3 Claims, 6 Drawing Figures

FUEL SUPPLY SYSTEM FOR AN INTERNAL COMBUSTION ENGINE

This invention is directed toward a system for providing the fuel requirements of an internal combustion engine and specifically toward such a system providing the start and warm-up fuel requirements of the engine.

It is well known that an enriched air-fuel mixture is required during cold start and warm-up periods in the operation of an internal combustion engine, the amount of enrichment decreasing as the engine temperature increases. Typically for start and warm-up fuel control, the temperature of the cylinder air-fuel mixture intake region is assumed to be always equal to the engine coolant fluid and the amount of fuel enrichment for engine starting and during the engine warm-up period is based on the sensed coolant temperature. However, this assumption is true only after long periods of engine shut down. Applicants have recognized that while fuel enrichment control based on engine coolant temperature may be satisfactory after the engine has been shut down for a long period of time, there are occasions at engine starting where the air-fuel intake region of the engine is at a temperature substantially higher than coolant temperature. When this condition exists, scheduling fuel enrichment based on coolant temperature results in an excessively rich air-fuel mixture being supplied to the engine combustion chambers. For example, after the engine is started, the temperature of the intake region increases at a rate faster than the increase in the engine coolant temperature toward a maximum differential temperature offset from coolant temperature when the engine is fully warmed up. If the engine is shut down and a start subsequently attempted before the temperature of the intake region has been allowed to decrease to the coolant temperature, fuel enrichment based on coolant temperature results in an excessively rich air-fuel mixture being delivered to the combustion space. This is particularly the case in a port fuel injection system where fuel is injected at the intake port-valve region whose temperature offset from coolant temperature is most dramatic. During this condition, the start and warm-up fuel requirements of the engine are best determined based on the temperature of the intake region of the engine such as at the intake ports in a port fuel injected engine.

In accord with this invention, the cold start and warm-up fuel requirements of an internal combustion engine are based on the temperature of the air-fuel mixture intake region of the engine so as to minimize the fuel enrichment for starting and operating the internal combustion engine and to avoid supplying an excessively rich mixture to the combustion space of the engine. In general, the temperature of the intake region of an engine is estimated based on the temperature of the engine coolant and the elapsed time of engine operation and engine shutdown. The fuel requirements of the engine are then provided based on this estimated inlet region temperature.

The invention may be best understood by reference to the following description of a preferred embodiment of the invention and the drawings in which.

Figure 1:
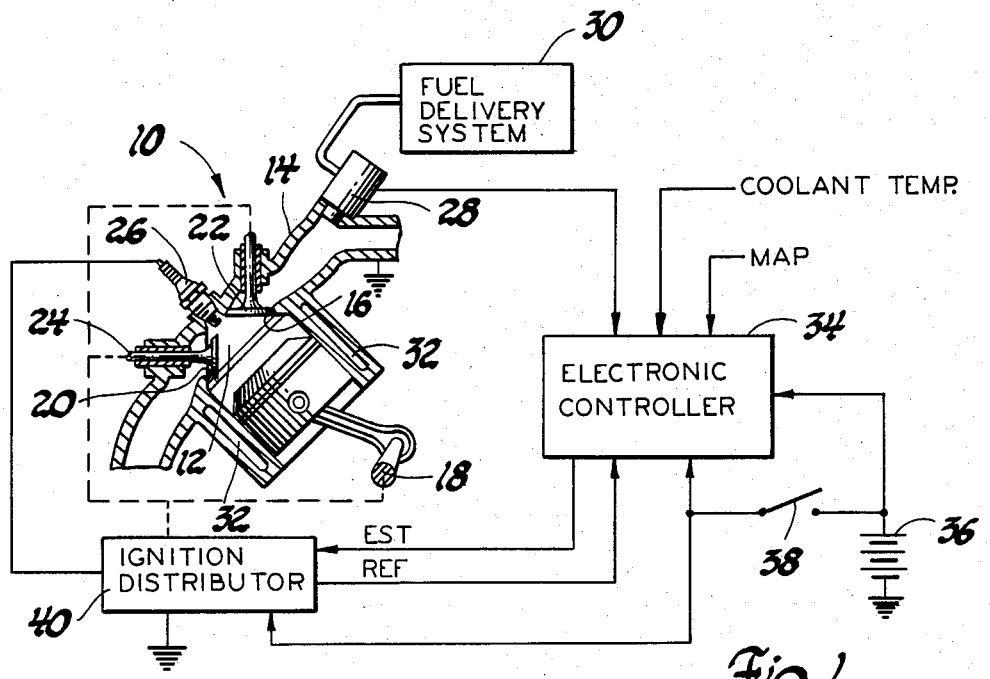
FIG. 1 illustrates in general a port fuel injection system in which the cold start and warm-up fuel requirements of the engine are provided in accord with the principles of this invention.

Referring to FIG. 1 a port fuel injected internal combustion engine 10 for an automotive vehicle includes a combustion chamber or cylinder 12 into which an air and fuel mixture is drawn from an intake manifold 14 through an intake port opening 16 where it is ignited to undergo combustion to cause rotation of the crankshaft 18. The combustion by-products are then exhausted through an exhaust port 20 and discharged to the atmosphere. The intake and exhaust ports 16 and 20 are opened and closed via intake and exhaust valve members 22 and 24 in timed relation to the rotation of the crankshaft 18. A spark plug 26 is provided for igniting the combustible mixture within the cylinder 12 when the spark plug 26 is energized.

The air drawn into the intake manifold 14 from the atmosphere is regulated by a conventional throttle valve (not shown). An electromagnetic fuel injector 28 injects fuel into the intake region of the cylinder 12 defined by the intake port 16, intake valve 22 and the manifold 14 in proximity to the intake port 16 where it is mixed with the incoming air to provide a combustible mixture. Fuel is provided to the injector 28 at a constant pressure from a conventional fuel delivery system 30. When the electromagnetic fuel injector 28 is energized, fuel is injected into the intake region of the cylinder 12 at a constant predetermined rate so that the amount of fuel is established by the time duration of energization of the fuel injector 28. A liquid coolant is circulated over the exterior wall of the cylinder 12 via passageways 32 of a conventional engine coolant system (not shown) to dissipate heat generated within the combustion chamber 12. Although only a single combustion chamber or cylinder 12 has been described, it will be readily appreciated that the illustrated internal combustion engine 10 may include additional cylinders 12 as desired each having associated therewith a fuel injector 28.

An electronic controller 34 is responsive to various engine operating parameters that may include, for example, the temperature of the coolant circulated through the engine 10 and the absolute pressure (MAP) in the intake manifold 14 to control the energization of the spark plug 26 and to control the energization of the fuel injector 28 to establish a desired ratio of the air-fuel mixture drawn into the engine 10. The electronic controller 34 receives switched operating voltage from the vehicle battery 36 via an ignition switch 38 and also receives unswitched battery voltage from the battery 36 so that at least portions of the electronic controller 34 may be energized when the ignition switch 38 is opened during periods of engine shut down. The switched battery voltage is also supplied to an ignition distributor 40. The ignition distributor 40 is conventional and provides timed spark pulses established by the electronic controller 34 for igniting the combustible mixture in the cylinder 12. The ignition distributor 40 also provides a reference pulse to the electronic controller 34 once with each engine cylinder intake event in timed relation to the rotation of the crankshaft 18. In this respect, the ignition distributor may provide the reference pulses by means of a conventional star wheel signal generator.

Conventionally, the air/fuel ratio of the mixture supplied to the engine and the amount of fuel required to produce this ratio is determined based upon the temperature of the coolant circulated through the passages 32, the air/fuel ratio being increased as the coolant temperature increases. When the engine 10 has been inoperative for a long period of time, the temperature of the coolant is substantially equal to the temperature of the intake region around the intake port 16. When the engine is first started and operated, the temperature of the intake region increases at a greater rate than the temperature of the coolant and eventually attains a predetermined maximum offset temperature from the temperature of the coolant. If the engine 10 is shut down and subsequently restarted while the temperature of the intake region is still higher than the coolant temperature, an air/fuel ratio established based on coolant temperature is the same as if the intake region was at the same temperature as the coolant. However, since the intake region temperature is higher than the temperature of the coolant fluid, the air/fuel ratio is richer than required and may result in deterioration in the engine performance.

In accord with this invention the fuel requirements of the engine 10 are dependent not on the temperature of the coolant circulated in the passages 32, but on the temperature of the intake region of the cylinder 12 in proximity to the intake port 16 where the fuel is injected. The electronic controller 34 estimates the temperature of the cylinder intake region based on the elapsed time of engine operation and engine shut down and coolant temperature and controls the fuel injector 28 in accord with the estimated intake region temperature to provide the fuel requirements of the engine 10.

In general, when the engine 10 is first operated after a long shut-down period, the cylinder 12 intake region temperature increases at a rate faster than the coolant fluid temperature and to a maximum offset temperature from the coolant temperature. When the engine is shut down after having been operated, the temperature of the cylinder 12 intake region decreases toward the coolant temperature. The time dependent variation of the difference between the cylinder 12 intake region temperature and the coolant temperature is empirically determined for both engine 10 operating and shutdown periods and an expression for each of the determined time dependent variations is stored in the electronic controller. These expressions are then utilized with the sensed coolant temperature to estimate the temperature of the cylinder 12 intake region.

Figure 2:
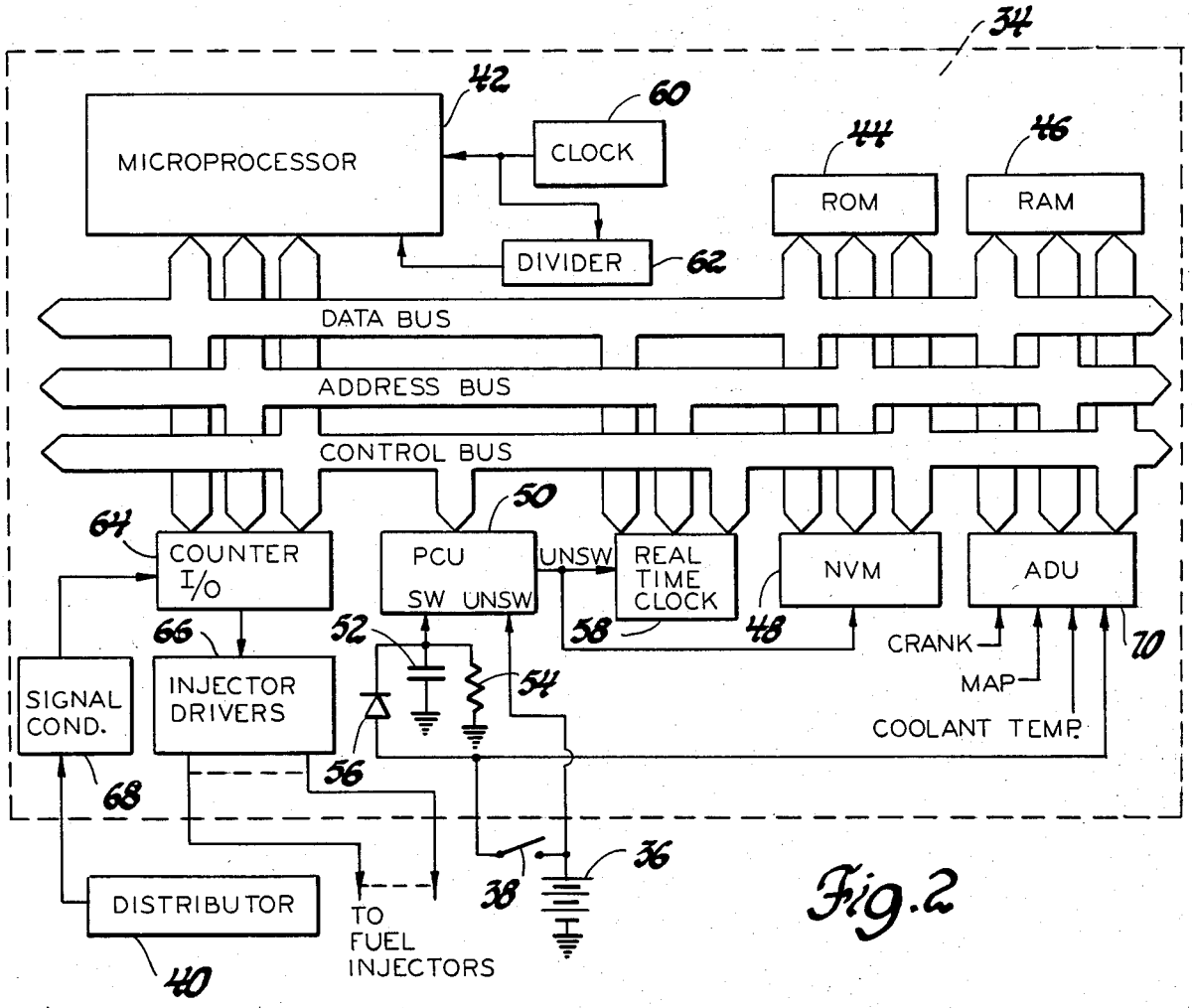
FIG. 2 illustrates a digital embodiment of the engine controller of FIG. 1.

In this embodiment, the electronic controller 34 takes the form of a digital controller as illustrated in FIG. 2. The electronic controller 34 includes a microprocessor 42 which executes an operating program permanently stored in an internal read only memory (ROM) 44 which also contains lookup tables and constants for controlling spark timing and fuel injection. Internal to the microprocessor 42 are conventional counters, registers, accumulators, flag flip flops, etc. Such a microprocessor may take the form of a Motorola MC-6800 series microprocessor.

The electronic controller 34 also includes a random access memory (RAM) 46 into which data may be temporarily stored and from which data may be read at various address locations determined in accord with the program stored in the ROM 44. A nonvolatile memory (NVM) 48 is provided into which data or information required to be retained during periods of engine shut down are stored. In this embodiment, the NVM 48 takes the form of a RAM that is continuously powered by an unswitched output of a power control unit (PCU) 50 that receives an unswitched voltage input from the vehicle battery 36. The PCU 50 also receives a switched voltage from the battery 36 via the conventional vehicle ignition switch 38.

When the ignition switch 38 is closed, the positive terminal of the vehicle battery 36 is coupled to a switched power input of the PCU 50 and across the parallel combination of a capacitor 52 and a resistor 54 through a diode 56. The PCU 50 provides a switched regulated voltage to the various circuits in the electronic controller 34 via the system control bus during the period that an operating voltage is applied to its switched input. When the ignition switch 38 is closed, the capacitor 52 is charged substantially instantaneously to the battery 36 voltage which is applied to the switched input of the PCU 50. When the ignition switch 38 is subsequently opened to shut down the engine 10, an operating voltage is applied to the switched input of the PCU 50 from across the capacitor 52 for a time period determined by the discharged time constant of the capacitor 52 and the resistor 54. Therefore, the PCU 50 supplies a regulated voltage to the system circuits via the control bus during the time that the ignition switch 38 is closed and for a time period after the ignition switch 38 is opened so that certain functions may be accomplished within the electronic controller 34 after the ignition switch 38 is opened to shut down the vehicle engine.

The unswitched output of the PCU 50 is also applied to a real-time clock 58 which runs continuously during periods of engine operation and during periods of engine shut down. The real-time clock may take the form of, for example, a National Semiconductor part number NM58174 microprocessor-compatible real-time clock. This clock may be addressed and read by the microprocessor 42 in accord with the program stored in the ROM 44. The real-time clock 58 includes an internal crystal oscillator and continuously times in seconds, minutes, hours and days.

A clock oscillator 60, which establishes the timing of the digital system, supplies a clock signal to the microprocessor 42 and to a divider 62 which issues a periodic interrupt pulse to a maskable interrupt of the microprocessor 42. These interrupt pulses may be spaced, for example, at $12\frac{1}{2}$ millisecond intervals.

A counter input/output circuit 64 is provided having an output counter section for issuing timed output pulses for energizing the fuel injectors 28 simultaneously via a driver circuit 66. In general, the counter input/output circuit 64 may include registers into which binary numbers representative of the desired injection pulse width are periodically inserted. Thereafter, the injection pulse is triggered by the reference pulse output of the vehicle distributor 40 via a signal conditioner 68. Since an injection pulse is provided with each reference pulse output of the distributor 40, the fuel injectors are energized by the injector driver circuit 66 once with each intake stroke of the internal combustion engine. This system is of the type typically referred to as synchronous injection.

An analog-to-digital unit (ADU) 70 provides for the measurement of analog signals and the sensing of discrete "on"-"off" signal levels. Discrete signals are applied to discrete inputs of the ADU 70 and the various analog signals to be measured are applied to the analog inputs. While the system may utilize a plurality of discrete signal inputs, a single discrete input is illustrated that represents the "on"-"off" state of the ignition switch 38. Analog signals representing the engine condition upon which the injection pulse widths are based are supplied to analog inputs of the ADU 70. In the present embodiment, those signals include a manifold absolute pressure (MAP) signal provided by a conventional pressure transducer monitoring the absolute pressure in the intake manifold 14 and an engine coolant temperature signal provided by a conventional temperature transducer.

The microprocessor 42 reads and stores the state of the ignition switch 38 discrete input to the ADU 70 in a designated RAM memory location in accord with the operating program stored in the ROM 44. The analog input signals to the ADU 70 are each sampled and converted under control of the microprocessor 42.

The various elements of the engine control unit 34 are interconnected by an address bus, a data bus and a control bus. The microprocessor 42 accesses the various circuits and memory locations in the ROM 44, RAM 46, NVM 48 and the real-time clock 58 via the address bus. Information is transmitted between the circuits via the data bus and the control bus includes conventional lines such as read/write lines, reset lines, clock lines, power supply lines, etc.

As previously indicated, the fuel supplied to the engine 10 is based on an estimated temperature of the cylinder 12 intake region which estimation is based on coolant temperature and the empirically derived expressions for estimating the time-dependent difference between the coolant and cylinder intake temperatures, the expressions being stored in the ROM 44 in the form of first order lag equations to be described.

Figure 3:
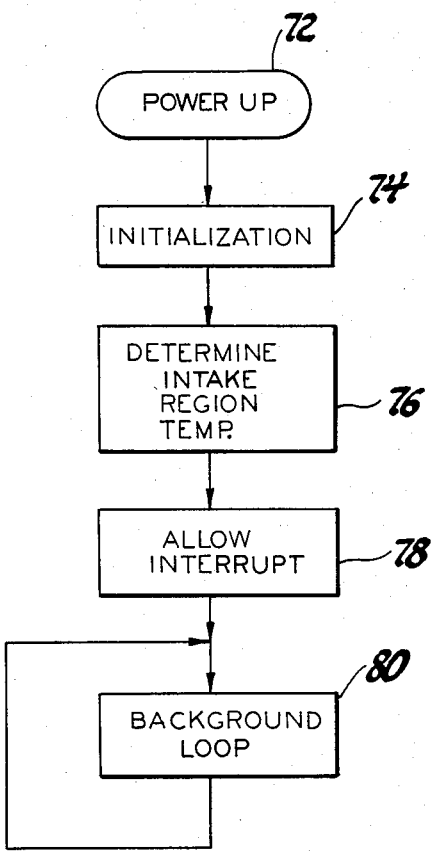
FIGS. 3 through 6 are diagrams illustrative of the operation of the digital engine controller of FIG. 2 in providing the cold start and warm-up fuel requirements of the engine in accord with the principles of this invention.

The operation of the electronic controller 34 in determining the injection pulse width required to produce the fuel requirements of the engine in accord with the principles of this invention is illustrated in FIGS. 3 through 6. Referring first to FIG. 3, when power is first applied to the system by closing the ignition switch 38, the computer program is initiated at point 72 and then proceeds to a step 74 where the computer provides for system initialization. For example, at this step, initial values stored in the ROM 44 are entered into ROM designated locations in the RAM 46 and counters, flags, and timers are initialized. After the initialization step 74, the program proceeds to a step 76 where a routine is executed to determine the cylinder intake region temperature to be used in establishing the start and initial warm-up fuel requirements of the engine 10. In the manner to be described, this routine estimates the cylinder intake region temperature based on the elapsed shut-down time of the engine and on coolant temperature. Following the step 76, the program proceeds to a step 78 where the program allows interrupts to occur such as by resetting the interrupt mask bit in the microprocessor condition code register. After step 78, the program shifts to a background loop 80 which is continuously repeated. This loop may include execution of various routines such as engine diagnostic and warning routines.

While the system may employ numerous program interrupts at various intervals, it will be assumed for purposes of illustrating this invention that an interrupt is provided at $12\frac{1}{2}$ millisecond intervals by means of the divider 62 of FIG. 2 during which a fuel control routine for determining the injection pulse width is executed.

Figure 4:
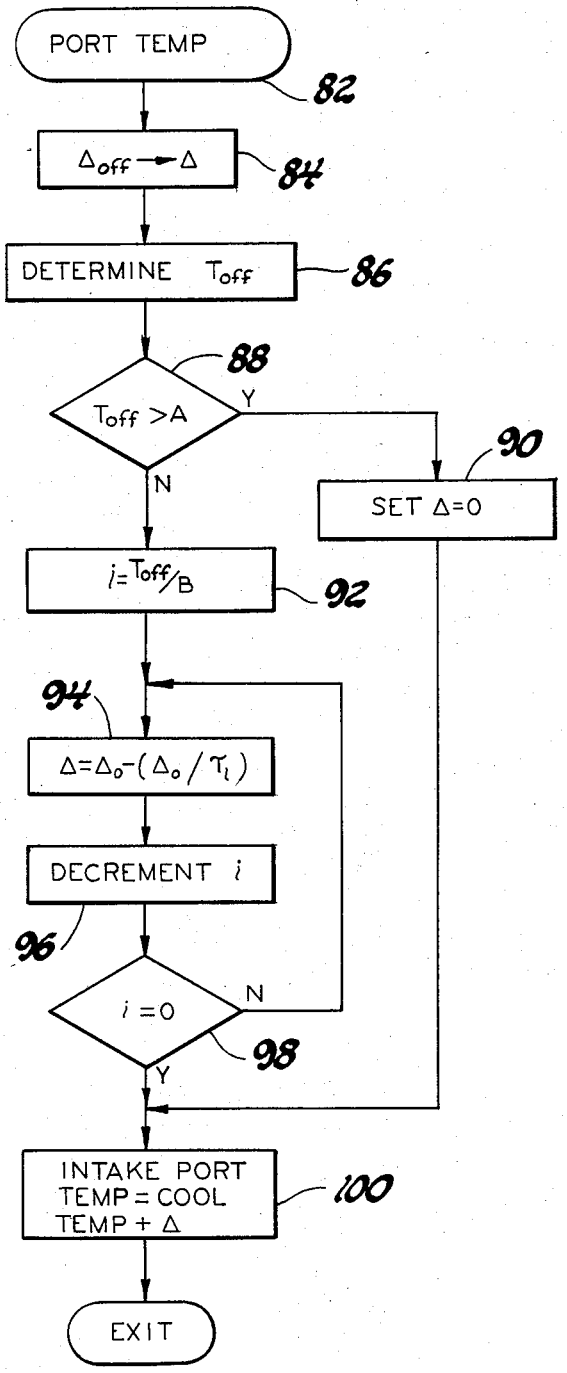

Referring to FIG. 4, the routine executed at step 76 for determining the cylinder intake region temperature when the system is first powered up is illustrated. This routine is entered at step 82 and proceeds to a step 84 where the difference $\Delta_{off}$ between the coolant temperature and the temperature of the cylinder intake region that existed at the time of the last engine shut down is retrieved from the NVM 48 and placed in a RAM 46 Δtemp memory location at which the temperature difference Δ between the coolant and cylinder intake region temperatures to be used in establishing the fuel requirements is stored.

The program next proceeds to a step 86 where the computer determines the elapsed time $T_{off}$ since the engine was last shut down. This is accomplished by comparing the present time condition of the real-time clock 58 with the time condition of the real-time clock 58 stored in the NVM 48 when the engine was last shut down. The determined lapsed time $T_{off}$ of engine shut down is then compared with a calibration constant A at decision point 88. If the engine has been shut down for a time period greater than A, which may be one hour, it is assumed that the cylinder intake region temperature is equal to coolant temperature and the program proceeds to a step 90 where the difference between the engine coolant temperature and the temperature of the cylinder intake region stored in the RAM 46 Δtemp memory is set to zero. If, however, the engine shut-down period $T_{off}$ is less than the calibration constant A, the program proceeds to estimate the value of the cylinder intake region temperature. This is accomplished by steps 92, 94, 96, and decision point 98 where the temperature difference Δ between the coolant temperature and the cylinder intake region temperature that existed when the engine was last shut down is decreased in accord with the aforementioned empirically derived expressions stored in the ROM 44 for estimating the time dependent difference in the temperatures.

At step 92, the initial value of an index number i related to the elapsed engine shut-down period $T_{off}$ is established by dividing $T_{off}$ by a calibration time increment B. Following step 92, a first order lag filter routine is executed at step 94 i times to simulate the decrease in the difference between the intake region temperature and the coolant temperature over the engine shut-down period $T_{off}$. The first order lag filter equation for simulating the change in the temperature difference takes the form of the expression $\Delta=\Delta_0-(\Delta_0/\tau_1)$, where Δ is the estimated temperature difference between the cylinder intake region and the coolant temperature to be stored in the RAM 46 Δtemp memory location, $\Delta_0$ is the previously determined difference between the cylinder intake region temperature and the coolant temperature now stored in the RAM 46 Δtemp memory location, and $\tau_1$ is a constant. The values of B and $\tau_1$ are selected so that the first order lag filter routine of step 94 substantially simulates the actual variation of the difference between the temperature of the cylinder intake region and the coolant temperature over time when the engine is shut down. The newly calculated temperature difference is stored in the RAM 46 Δtemp memory location.

After each execution of the step 94, the program proceeds to step 96 where the index number i is decremented and thereafter at decision point 98 compared to zero. If i is greater than zero, the program returns to the step 94 which is again executed. In this manner, the first order lag routine of step 94 is executed i times to provide the estimated temperature differential between the cylinder intake region and the coolant temperature at a time $T_{off}$ after engine shut down.

At step 100, the temperature differential between the cylinder intake region temperature and the coolant temperature stored in the RAM 46 Δtemp memory location is added to the coolant temperature to determine the estimated temperature of the cylinder intake region. This temperature is then stored in the RAM at a ROM designated location to be used to establish the start and the initial warm-up fuel requirements of the engine 10.

Figure 5:
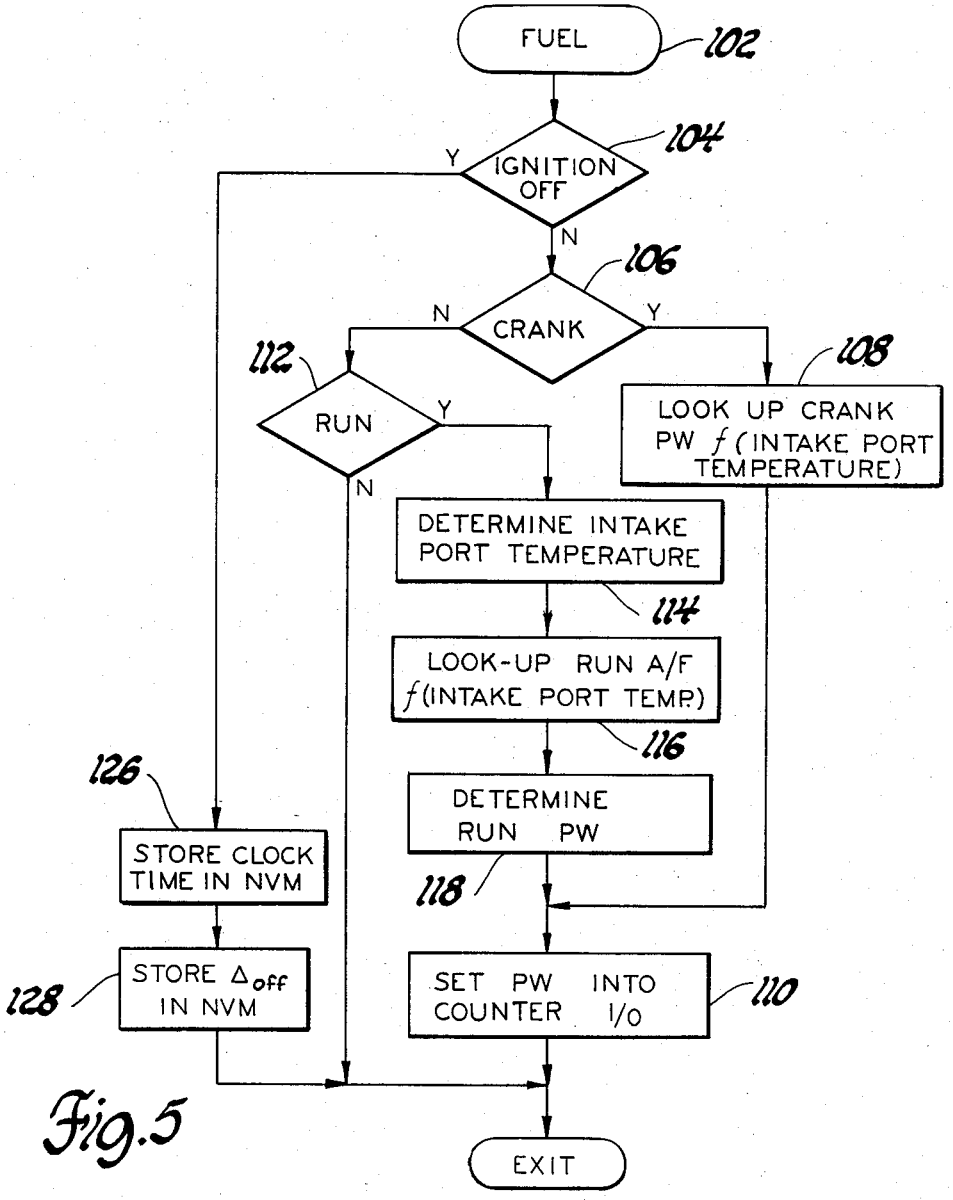

The fuel requirements of the engine 10 are established by a routine illustrated in FIG. 5 and which is executed during each interrupt of the microprocessor 42. Referring to FIG. 5, the fuel control routine is entered at point 102 and proceeds to a decision point 104 where the condition of the ignition switch as represented by the discrete input to the ADU 70 is determined. If the ignition switch is on, the program proceeds to a decision point 106 to determine whether or not the engine is cranking. In this respect, cranking may be implied by sensing reference pulses from the distributor 40 below a predetermined frequency. If the engine is cranking, the program proceeds to a step 108 where the fuel injection pulse width is determined by addressing a lookup table in the ROM 44 at which crank injection pulse widths are stored as a function of the cylinder intake region temperature. It is noted that this intake region temperature was determined by the routine of FIG. 4 when power was first applied to the electronic controller 34. From step 108, the program proceeds to a step 110 where the pulse width looked up as a function of the cylinder intake region temperature is set into the input/output counter 64 of FIG. 2 and subsequently issued to energize the fuel injectors in timed relation to the output pulses from the distributor 40.

Returning again to decision point 106, if the engine is not cranking, the program proceeds to a decision point 112 where it is determined if the engine is running as represented, for example, by the reference pulses from the distributor 40 exceeding a predetermined frequency. If the engine is not running, the program exits the routine. However, if it is determined that the engine is running, the program proceeds from decision point 112 to a step 114 where a routine is executed to estimate the cylinder intake region temperature based on the elapsed time of engine operation and the engine coolant temperature. This routine will be described with reference to FIG. 6.

Following step 114, the program proceeds to a step 116 where the program executes a lookup routine to determine the desired air/fuel ratio of the mixture to be supplied to the cylinder 12. This lookup table is stored in the ROM 44 and contains air/fuel ratio values as a function of the cylinder intake region temperature. Typically, the air/fuel ratios will be less than stoichiometry for cold engine operation increasing to a stoichiometric ratio at a predetermined cylinder intake region temperature.

From step 116, the program proceeds to a step 118 where the pulse width required to establish the air/fuel ratio looked up at step 116 is determined. This pulse width is determined by sampling the value of manifold absolute pressure supplied to the ADU 70 and determining the pulse width required to energize the injectors to obtain the desired air/fuel ratio. Following step 118, the determined pulse width value is set into the input/output counter 64 at step 110. As previously indicated, this pulse will be issued upon the provision of the next reference pulse by the distributor 40. Thereafter, the program exits the fuel control routine.

Figure 6:
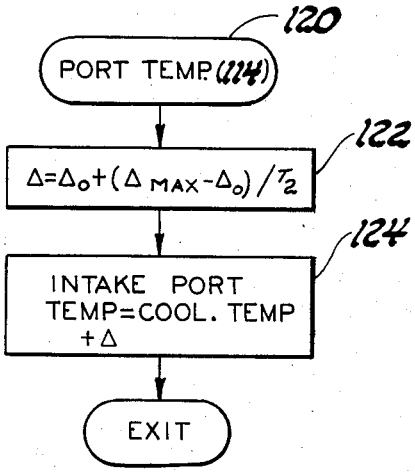

As long as the engine continues to run, the intake port temperature is continually updated at step 114 with each interrupt of the microprocessor 42. The routine of step 114 is illustrated in FIG. 6. Referring to this figure, the routine is entered at point 120 and proceeds to a step 122 where a new value of the temperature difference Δ between the engine coolant and the cylinder intake region is calculated based upon the expression $\Delta=\Delta_0+(\Delta_{max}-\Delta_0)/\tau_2$ where Δ is the new estimated temperature difference to be stored in the RAM 46 Δtemp memory location, $\Delta_0$ is the previous estimated temperature difference now stored in the RAM 46 Δtemp memory location, $\Delta_{max}$ is a constant that is the maximum temperature difference that will be attained, and $\tau_2$ is a constant. This expression is in the form of a first order lag filter having a time constant determined by the constant $\tau_2$ and wherein the estimated temperature difference Δ approaches the constant $\Delta_{max}$. The constants $\Delta_{max}$ and $\tau_2$ are selected so that the first order lag filter equation substantially simulates the actual difference between the coolant temperature and the cylinder intake temperature during engine operation. The newly estimated temperature difference is then stored in the RAM 46 Δtemp memory location.

From step 122, the program proceeds to a step 124 where the cylinder intake region temperature is determined by summing the coolant temperature provided via the ADU 70 and the estimated temperature difference stored in the RAM 46 Δtemp memory location. From step 124, the program exits the routine and proceeds to step 116 of FIG. 5 at which the air/fuel ratio of the mixture supplied to the cylinder 12 is determined based on the estimated cylinder intake region temperature determined at step 114.

Returning again to step 104 of FIG. 5, if it is determined that the ignition switch has been turned to its off position to shut down the engine 10, the program proceeds to step 126 where the time of shut down is read from the real-time clock 58 and stored in a ROM designated memory location in the NVM 48. This time is then subsequently used at step 76 of FIG. 3 when the system is next powered up to estimate the cylinder intake region temperature based on the elapsed period $T_{off}$ of engine shut down. From step 126, the program proceeds to step 128 where the temperature difference value stored in the RAM 46 Δtemp memory location is stored in a ROM designated memory location in the NVM 48. This temperature difference value is used during execution of the step 76 of FIG. 3 when the system is next powered up to estimate the cylinder intake region temperature.

From the foregoing, it can be seen that the fuel requirements of the engine are provided based on an estimated temperature of the intake region of the engine determined in accord with predetermined engine shut down and operating schedules and which more precisely provides for the fuel requirements of the engine during start and warm-up operations.

While the invention has been described for use with a port fuel injected engine, it is applicable to other fuel delivery systems. For example, the invention is applicable to a throttle body injection system where fuel is delivered to a single intake point and to an electronically controlled carburetor where the air/fuel ratio may be controlled in accord with predetermined schedules.

The foregoing description of a preferred embodiment of the invention for the purpose of illustrating the invention is not to be considered as limiting or restricting the invention since many modifications may be made by the exercise of skill in the art without departing from the scope of the invention.

The embodiments of the invention in which an exclusive property or privilege is claimed are defined as follows:

1. A system for providing the fuel requirements of an internal combustion engine cooled by a liquid coolant circulated therethrough and having an air-fuel intake region whose temperature increases to a value above the coolant temperature during engine operation, the system comprising:

means effective to sense the coolant temperature;

means effective to generate an estimated temperature signal having a value representing an estimated temperature of the air-fuel intake region, the last mentioned means (A) determining the value of the estimated temperature signal in accord with a predetermined engine operation schedule based on the elapsed time of engine operation and the sensed coolant temperature and (B) determining the value of the estimated temperature signal in accord with a predetermined engine shut down schedule based on the elapsed time of engine shut down and the sensed coolant temperature; and means effective to supply fuel to the air-fuel intake region in accord with the value of the estimated temperature of the air-fuel intake region.

2. A system for providing the start and warm-up fuel requirements of an internal combustion engine cooled by a liquid coolant circulated therethrough and having an air-fuel intake region whose temperature increases to a value above the coolant temperature during engine operation, the system comprising:

means effective to sense the coolant temperature;

means effective to generate an estimated temperature difference signal having a value representing an estimated difference between the temperature of the air-fuel intake region and coolant temperature, the last mentioned means (A) determining the value of the estimated temperature difference signal in accord with a predetermined engine operation schedule based on the elapsed time of engine operation and (B) determining the value of the estimated temperature difference signal in accord with a predetermined engine shut down schedule based on the elapsed time of engine shut down;

means effective to generate an estimated temperature signal that is the sum of the estimated temperature difference signal and coolant temperature, the estimated temperature signal representing an estimated temperature of the air-fuel intake region; and means effective to supply fuel to the air-fuel intake region during engine start and warm-up in accord with the value of the estimated temperature of the air-fuel intake region.

3. The method of providing the start and warm-up fuel requirements of an internal combustion engine cooled by a liquid coolant circulated therethrough and having an air-fuel intake region whose temperature increases to a value above the coolant temperature during engine operation, the method comprising the steps of:

(A) sensing coolant temperature;

(B) estimating the temperature of the air-fuel intake region based on coolant temperature and the elapsed time of engine operation and engine shut down; and (C) supplying fuel to the air-fuel intake region during engine start and warm-up in accord with the estimated air-fuel intake region temperature.

* * * * *